US008085121B2

(12) United States Patent
Hanov

(10) Patent No.: US 8,085,121 B2
(45) Date of Patent: Dec. 27, 2011

(54) TRANSFORMER WITH ELECTRICAL SHIELD

(75) Inventor: Rudolf Hanov, Weilheim (DE)

(73) Assignee: Siemens Aktiengesellschaft, Munich (DE)

( * ) Notice: Subject to any disclaimer, the term of this patent is extended or adjusted under 35 U.S.C. 154(b) by 1058 days.

(21) Appl. No.: 11/910,280

(22) PCT Filed: Mar. 23, 2006

(86) PCT No.: PCT/EP2006/060974

§ 371 (c)(1),
(2), (4) Date: Oct. 1, 2007

(87) PCT Pub. No.: WO2006/103193

PCT Pub. Date: Oct. 5, 2006

(65) Prior Publication Data

US 2008/0211611 A1 Sep. 4, 2008

(30) Foreign Application Priority Data

Apr. 1, 2005 (DE) ..... 10 2005 015 785

(51) Int. Cl.
*H01F 27/32* (2006.01)

(52) U.S. Cl. ..... 336/84 C

(58) Field of Classification Search ..... 336/65, 336/84 R, 84 C, 90–96, 180–184
See application file for complete search history.

(56) References Cited

U.S. PATENT DOCUMENTS

| | | | | |
|---|---|---|---|---|
| 2,731,589 | A * | 1/1956 | Marsh | 363/59 |
| 3,201,728 | A | 8/1965 | McWhirther | |
| 3,265,998 | A * | 8/1966 | Park | 336/70 |
| 3,742,332 | A * | 6/1973 | Koblick et al. | 327/443 |
| 4,176,334 | A | 11/1979 | Buritz et al. | |
| 4,459,575 | A * | 7/1984 | Geissler et al. | 336/84 R |
| 4,523,171 | A | 6/1985 | Altmann et al. | |
| 7,023,312 | B1 | 4/2006 | Lanoue et al. | |

FOREIGN PATENT DOCUMENTS

| | | |
|---|---|---|
| DE | T 10549 | 3/1956 |
| DE | 1 921 610 | 8/1965 |
| DE | 1 763 515 | 12/1971 |
| DE | 89 14 262.4 | 3/1990 |
| DE | 41 23 812 A1 | 1/1993 |
| DE | 198 09 572 A1 | 10/1999 |
| EP | 0 102 513 A1 | 3/1984 |
| WO | 03/107364 A1 | 12/2003 |

* cited by examiner

*Primary Examiner* — Tuyen Nguyen
(74) *Attorney, Agent, or Firm* — Laurence A. Greenberg; Werner H. Stemer; Ralph E. Locher

(57) ABSTRACT

A transformer, in particular an entirely cast resin transformer, includes at least one lower voltage winding and at least one upper voltage winding. The application of an electrical shielding around the upper voltage winding makes it possible to prevent a voltage disruptive discharge in such a way that the outer wall of the transformer can be touched by a person and also provides the transformer with electromagnetic shielding. The transformer is provided with bushings for internal electric connections and for that reason, it can be placed in media affected by dirty surroundings and in open air.

11 Claims, 3 Drawing Sheets

TRANSFORMER WITH ELECTRICAL SHIELD

BACKGROUND OF THE INVENTION

Field of the Invention

The invention relate to a transformer, in particular a cast-resin transformer, having at least one lower voltage winding and at least one upper voltage winding.

When producing a transformer, in particular a cast-resin transformer, and subsequently installing it in very different environments, a very wide variety of safety aspects need to be taken into consideration. Owing to the voltages used in the medium-voltage and high-voltage range, it is absolutely necessary to prevent the outer casing of the transformer from being touched. For this reason, the transformers are protected by external covers or protective walls.

Furthermore, only electrical shields between the primary winding and the lower voltage winding of the transformer are known from the prior art. This shielding reduces the capacitive and/or inductive coupling of the windings to one another and reduces the coupling impedance at higher frequencies. For example, DE 41 23 812 A1 describes a transformer having at least one primary winding and at least one lower voltage winding, a shield being arranged between the primary winding and the lower voltage winding, which shield is connected to the ground of the transformer via a nonreactive resistor. This therefore likewise results in the reduction of undesired stray inductances and/or stray impedances in the transformer windings.

DE 89 14 262.4 U1 describes a transformer with shielding windings between the primary winding and the lower voltage winding. In this case, a shield is selected as an insulated, electrically unclosed winding consisting of a magnetizable material. In order to avoid a short circuit in the electrical shield, no closed winding should be provided.

One disadvantage with all the previous transformers, in particular cast-resin transformers, from the prior art is the need for a complex protective housing or outer protection around the transformer when it is installed outdoors. A protective housing is likewise necessary when installing the transformer in climatically unfavorable or severely contaminated environments. In cast-resin transformers, this protective housing is also required for preventing a person from touching the transformer. In order to avoid a voltage flashover, the distance between the outer protective housing and the outside of the transformer needs to be selected to be sufficiently great according to the prior art. Owing to this disadvantage, it is necessary to provide larger actuating faces than is necessary for the operation of a transformer.

BRIEF SUMMARY OF THE INVENTION

The object of the present invention is therefore to provide a compact transformer which is easy to produce and has protection against electric shock.

According to the invention, the object is achieved by virtue of the fact that an electrical shield is arranged around the upper voltage winding. The upper voltage winding is in particular a medium-voltage or high-voltage winding. As a result, the voltage potential between the coil surface and the upper voltage winding, which may be carrying a high voltage, is advantageously set to zero, and therefore a voltage flashover is prevented even in the event of touching contact by a person. Advantageously, the electrical shield surrounds the upper voltage winding virtually completely apart from the incoming and outgoing electrical lines.

In an advantageous configuration of the transformer, the electrical shield is connected to the electrical ground and is therefore grounded. Owing to the grounding of the electrical shield, the risk of a person touching the electrical shield is minimized or prevented. Advantageously, the electrical shield coaxially surrounds the cylindrical upper voltage winding, the electrical shield being interrupted in the radial direction, and the interspace thus produced insulating the ends of the electrical shield in the radial direction with respect to one another. In this case, the ends of the shield need to overlap one another. This advantageous configuration of the electrical shield prevents short-circuit currents within the electrical shield. In the interspace, in addition insulation may prevent an electrical connection between the thus created ends of the electrical shield. Advantageously, the ends of the electrical shield overlap one another in order to ensure complete shielding. In the region of overlap, insulation, ideally a thin insulating film, can be introduced so as to avoid short-circuit currents.

In an advantageous configuration of the transformer, the electrical shield is an electrically conductive material, such as a braided wire, for example, and therefore represents a Faraday cage. The transformer is preferably configured in such a way that the distance of the interspace between the electrical shield and the upper voltage winding is selected such that, depending on the dielectric located in the interspace between the electrical shield and the primary winding, protection against a voltage breakdown is provided. In the event of the transformer being cast with cast resin, the distance of the shield from the upper voltage winding is to be selected such that a voltage breakdown via the cast resin located in the interspace is ruled out. This distance should be selected in a similar manner for other insulation materials.

In order to ensure the installation of a cast-resin transformer which has been possible to date in climatically unfavorable environments or environments which are susceptible to contamination for the transformer according to the invention as well, the electrical shield needs to be protected against external contact influences. In the simplest case, this can be ensured by an outer plate. Likewise, casting of a transformer with cast resin, a so-called "casting", provides the possibility of the casting surrounding the electrical shield and of a distance remaining between the outer wall of the casting and the electrical shield. Owing to the fact that the upper voltage winding and the electrical shield are cast jointly, partial discharges are substantially reduced since the interspace between the upper voltage winding and the shield is not filled with air. At the same time, the joint casting increases the dimensional stability of the electrical shield and ensures a constant distance between the upper voltage winding and the electrical shield.

In an alternative configuration, the upper voltage winding with the electrical shield and the lower voltage winding are cast jointly with cast resin. As a result a very compact design of the transformer is possible and, at the same time, a dimensionally stable and positionally stable electrical shield around the upper voltage winding is ensured.

In one advantageous configuration, the transformer has at least one guide for the electrical connections, which are located in the interior of the transformer, of the upper voltage winding and/or of the lower voltage winding, the guide being connected to a bushing arranged on the outer wall of the transformer. Owing to this electrical shielding on all sides and grounding of the outer transformer casing, complete electrical shielding and therefore protection against electric shock for people is provided. Furthermore, this provides the possibility provided for cast-resin transformers of an installation of the transformer in climatically unfavorable environments or environments which are susceptible to contamination for the transformer according to the invention as well. Advantageously, the bushing and/or the fixing flange are connected to the electrical shield and therefore to ground.

Advantageously, the transformer comprises at least two castings, an upper voltage winding with shield and a lower voltage winding being cast together in each casting. The castings thus produced are arranged around a common core, the upper voltage windings and/or the respective electrical shields and/or the lower voltage windings in each case being interconnected by means of plugs/connectors and high-voltage cables. Owing to the use of plugs, a rapid connection of the windings is provided.

Advantageously, the transformer designed in this way is cooled by an air-cooling and/or water-cooling system in the interspace between the upper voltage winding and the lower voltage winding. In order to assist the circulation of heat and therefore the transport of heat within the cooling channels, fans are arranged in a suitable manner. In particular, in the case of a horizontal arrangement of the transformer according to the invention with an air-cooling system, the fan prevents an accumulation of heat within the cooling channels and therefore damage to the transformer. Alternatively, in the case of an air-cooling and/or liquid-cooling system, the use of an external heat exchange device is possible. This configuration according to the invention is primarily suitable in the case of installation on ships.

Further embodiments according to the invention can be found in the dependent claims. The invention will be explained in more detail with reference to the following drawings, in which:

DESCRIPTION OF THE INVENTION

Figure 1:
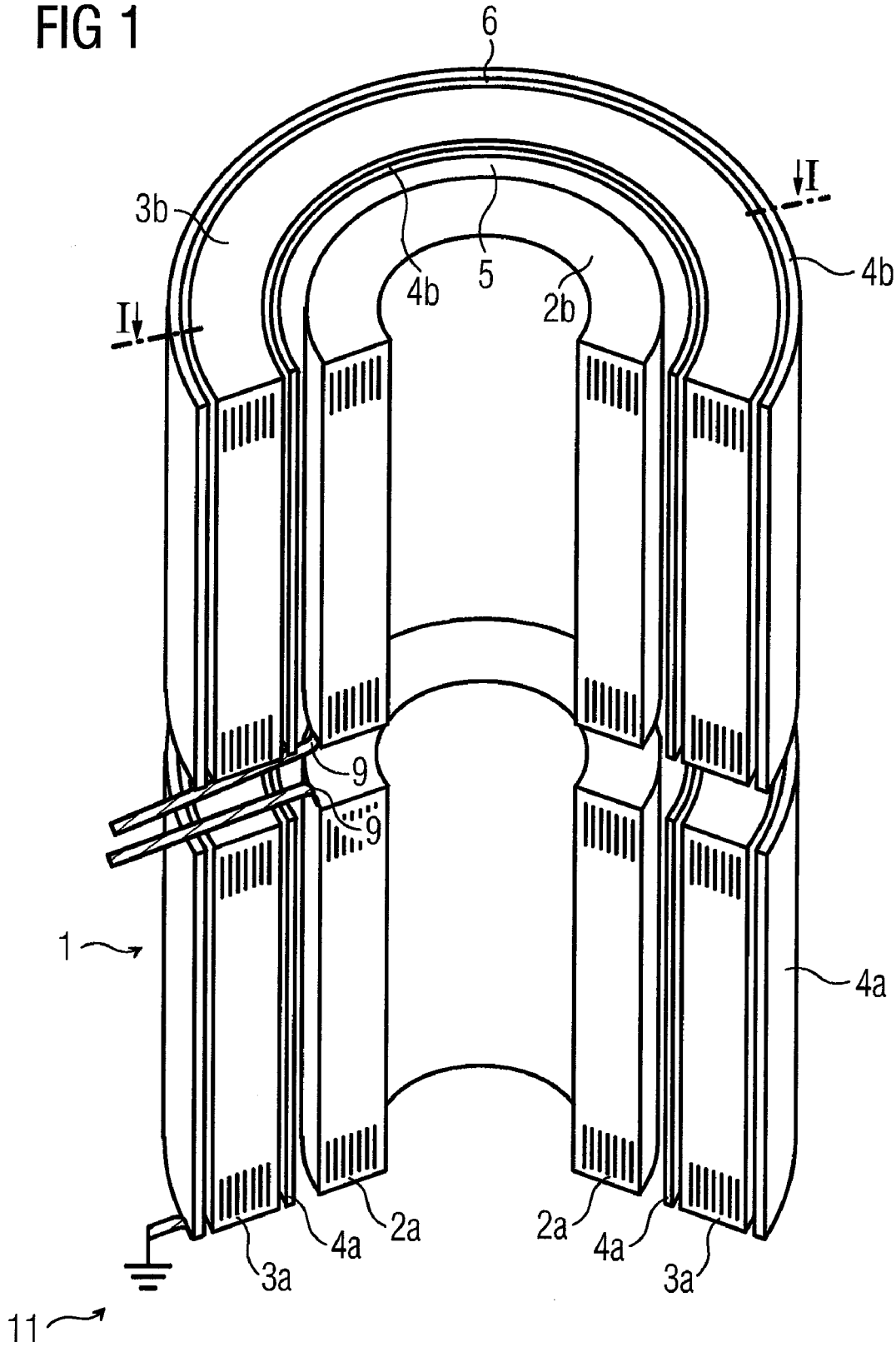
FIG. 1 shows a perspective, partially sectional drawing of the transformer according to the invention with two shielded upper voltage and lower voltage windings according to the invention.

FIG. 1 shows a perspective, partially sectional drawing of the transformer 1 according to the invention with two electrically connected upper voltage windings 3*a*, 3*b* and two lower voltage windings 2*a*, 2*b*, the upper voltage windings 3*a*, 3*b* coaxially surrounding the lower voltage windings 2*a*, 2*b*. The lower voltage windings 2*a*, 2*b* each have electrical connections 9, a guide 8 making it possible to connect the electrical connections 9 outside of the transformer 1 by means of a bushing 10. An electrical shield 4*a*, 4*b*, which is connected to the electrical ground 11, is arranged around the upper voltage winding 3*a*, 3*b*. The electrical shield 4*a*, 4*b* in this case surrounds the upper voltage windings 3*a*, 3*b* in each case virtually completely in the axial direction. In the partial drawing, no bushing 10 is illustrated for reasons of clarity.

Figure 2:
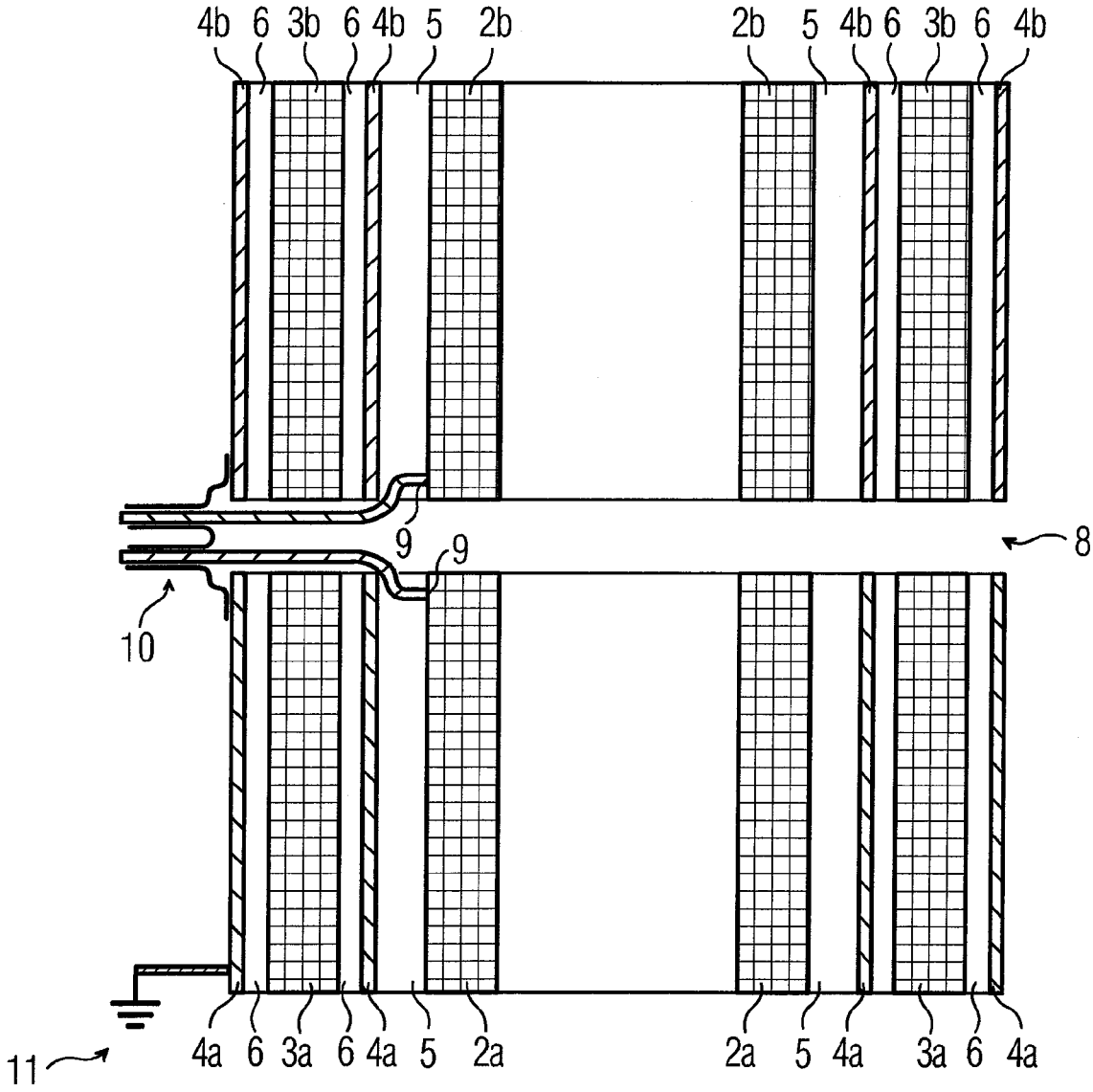
FIG. 2 shows a sectional drawing along the line I-I in FIG. 1.

FIG. 2 is a sectional drawing through the perspective illustration of FIG. 1 along the line I-I. The lower voltage windings 2*a*, 2*b* are connected to the bushing 10, such as produced by the company Elastimold®, located on the outer wall of the transformer 1 via electrical connections 9 within the guide 8. In the example illustrated, the bushing 10 is arranged on the outer wall of the transformer 1, in the present example this being the electrical shield 4*a*, 4*b*. As a result, the fixing flange 10 is electrically connected to the electrical shield 4*a*, 4*b* and electrically grounded by the electrical connection to ground 11. The distance 5 between the lower voltage windings 2*a*, 2*b* and the upper voltage windings 3*a*, 3*b* can be used as a cooling channel. It is also possible for the partial segments of the transformer 1 to be cast individually and for these so-called castings, comprising in each case one upper voltage winding 3*a*, lower voltage winding 2*a* and the electrical shield 4*a*, to be dimensioned such that the outer wall of this casting goes beyond the electrical shield 4*a* in the axial direction. This distance should be selected in such a way that a voltage flashover from the electrical shield 4*a* to the outer wall of the casting (not illustrated here) is ensured. Furthermore, a transformer 1 designed according to the invention, despite the embodiments of the lines on the outside of the transformer 1 according to the invention, makes it possible for cast-resin transformers to be installed in climatically unfavorable environments or environments which are susceptible to contamination. Owing to the use of bushings 10 protected on both sides on the outer wall of the transformer 1, the possible ingress of dirt is suppressed.

Figure 3:
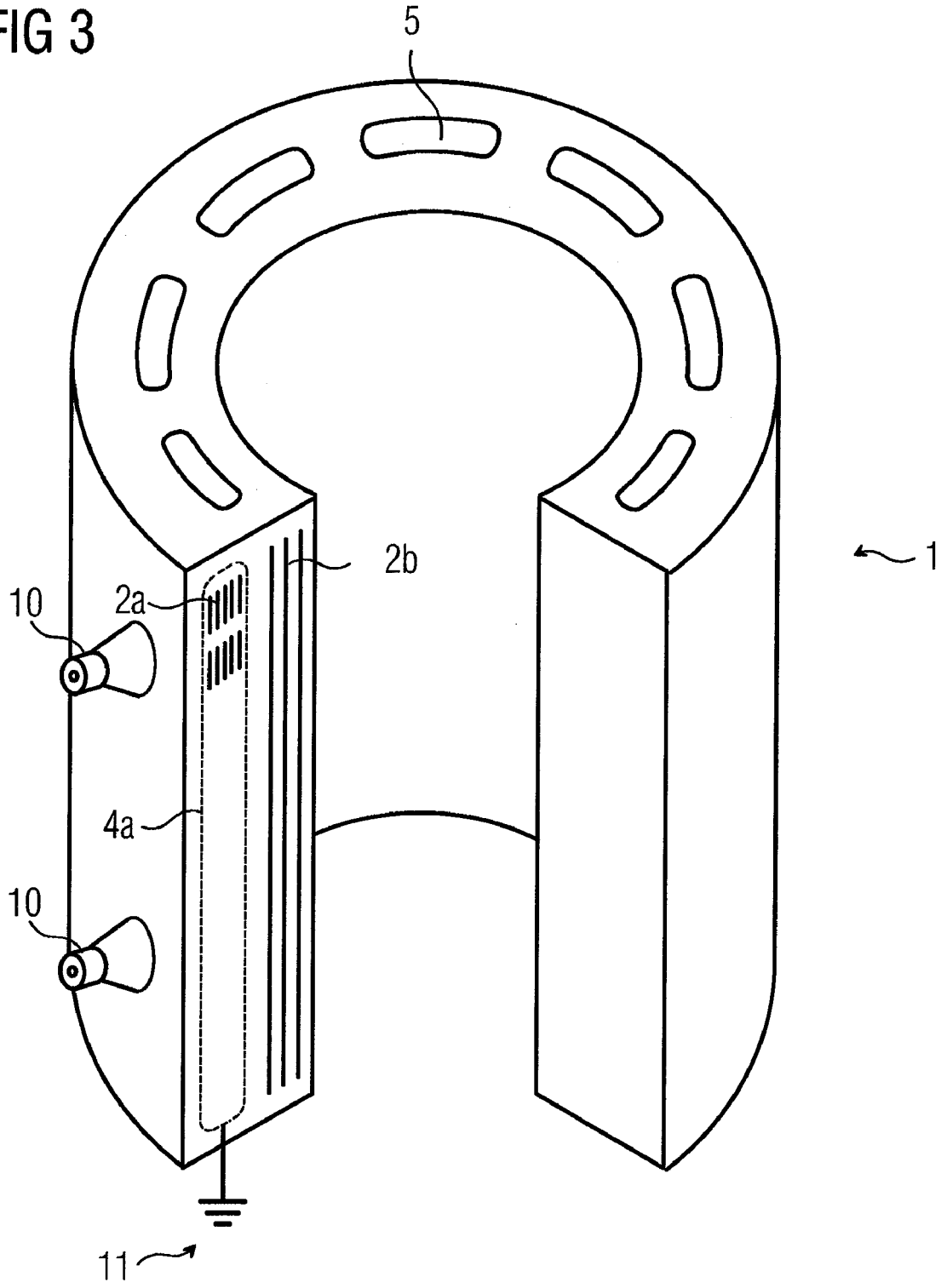
FIG. 3 shows a perspective, partially sectional drawing of the transformer according to the invention with a shielded upper voltage winding according to the invention and a lower voltage winding.

FIG. 3 shows a perspective, partially sectional drawing of the transformer 1 according to the invention with an electrically shielded upper voltage winding 3*a* and a lower voltage winding 2*a*, the upper voltage winding 3*a* coaxially surrounding the lower voltage winding 2*a*. The electrical shield 4*a* in the form of a braided wire is only indicated as a dashed line. The upper voltage winding 3*a* is almost completely surrounded by the electrical shield 4*a* and cast jointly with cast resin. At the same time, the lower voltage winding 2*b*, only indicated schematically, is likewise cast with the electrically shielded upper voltage winding 2*a*. This allows for a very compact design of the transformer according to the invention. Cooling channels are formed in the casting between the shielded upper voltage winding 2*a* and the lower voltage winding 2*b*, these interspaces being formed by suitable rod-shaped elements during the casting process. The arrangement, shape and size of the interspaces 5 need to be matched to the respective requirements, such as the expected thermal loading or the thermal capacity of the cooling medium, for example.

The invention claimed is:

1. A transformer, comprising:

at least one lower voltage winding;

at least one upper voltage winding; and an electrical shield disposed around said upper voltage winding, said electrical shield being connected to electrical ground.

2. The transformer according to claim 1, wherein said electrical shield substantially completely surrounds said upper voltage winding.

3. The transformer according to claim 1, wherein said electrical shield coaxially surrounds said upper voltage winding defining an interspace therebetween, and said interspace between said electrical shield and said upper voltage winding acts as an insulator.

4. The transformer according to claim 1, wherein said electrical shield is formed of an electrically conductive material.

5. The transformer according to claim 3, wherein said electrical shield and said upper voltage winding are spaced apart by a distance forming said interspace providing protection against a voltage breakdown in dependence on a dielectric located in said interspace.

6. The transformer according to claim 1, wherein said upper voltage winding and said electrical shield are cast together with cast resin.

7. The transformer according to claim 1, wherein said upper voltage winding with said electrical shield and said lower voltage winding are cast together with cast resin.

8. The transformer according to claim 1, which further comprises:

electrical connections disposed in an interior of the transformer for at least one of said upper voltage winding or said lower voltage winding;

at least one guide for said electrical connections; and a bushing connected to said at least one guide, disposed on an outer wall of the transformer and connected to ground.

9. The transformer according to claim 8, wherein at least one of said guide or said bushing is connected to said electrical shield.

10. The transformer according to claim 7, wherein:

said electrical shield is one of at least two electrical shields;

said at least one upper voltage winding is at least two upper voltage windings each being cast with the another and associated with a respective one of said electrical shields;

said at least one lower voltage winding is at least two lower voltage windings;

said windings have a common core; and at least one of said upper voltage windings or said lower voltage windings or said respective electrical shields are interconnected.

11. The transformer according to claim 1, which further comprises an air-cooling and/or water-cooling system disposed in an interspace between said upper voltage winding and said lower voltage winding.

* * * * *